United States Patent [19]

Hubbell

[11] Patent Number: 4,575,019

[45] Date of Patent: Mar. 11, 1986

[54] STEEL SLITTER RECOILER GUARD

[75] Inventor: William R. Hubbell, Hoffman Estates, Ill.

[73] Assignee: A & W Industries, Inc., Franklin Park, Ill.

[21] Appl. No.: 692,213

[22] Filed: Jan. 17, 1985

[51] Int. Cl.[4] ..... B21C 47/02; B65H 27/00; F16P 1/00

[52] U.S. Cl. ..... 242/78.1; 242/76; 74/608

[58] Field of Search ..... 242/78.1, 76, 56.1, 242/56.9; 74/608, 609; 226/196, 199

[56] References Cited

U.S. PATENT DOCUMENTS

| | | | |
|---|---|---|---|
| 535,974 | 3/1895 | Allis | 242/76 |
| 1,182,388 | 5/1916 | Kurowski | 242/76 |
| 1,774,525 | 9/1930 | Remmen | 242/78.1 |
| 2,224,997 | 12/1940 | Weisse | 242/78.1 |
| 3,761,034 | 3/1972 | Service | 242/78.1 |
| 4,369,571 | 1/1983 | Sugalski | 252/56.1 |

FOREIGN PATENT DOCUMENTS

| | | | |
|---|---|---|---|
| 944782 | 4/1974 | Canada | 242/76 |

*Primary Examiner*—Stuart S. Levy
*Assistant Examiner*—Lloyd D. Doigan
*Attorney, Agent, or Firm*—Lyman R. Lyon

[57] ABSTRACT

A guard for a steel strip recoiler precludes a "pinch point" between the revolving coil of steel and the advancing strip. A lower shroud prevents access to the periphery of the drum and an upper skid plate precludes access to the underside of the advancing strip. The drum shroud and skid plate are angularly related so as to converge to define a narrow slit which accepts cardboard filler strips but which precludes an operator's hand from passage therethrough.

3 Claims, 3 Drawing Figures

STEEL SLITTER RECOILER GUARD

BACKGROUND OF THE INVENTION

Rewinding of steel strip after slitting thereof is a high speed, relatively dangerous operation, complicated by the requirement that cardboard filler strips be inserted between convolutions of the coil of steel strip incident to the rewinding process. Both the quantity and spacing of the cardboard filler strips are visually determined by a machine operator who manually inserts the filler strips between convolutions as the band of steel are wound on the takeup drum. In the absence of a guard, the slightest error in filler strip insertion can result in the operator's hand being drawn between the rapidly advancing band of steel and the revolving coil.

SUMMARY OF THE INVENTION

The invention relates to a guard for a steel strip recoiler that precludes a "pinch point" between the advancing strip and the revolving coil of steel. A lower shroud prevents access to the periphery of the drum and an upper skid plate precludes access to the underside of the advancing strip. The drum shroud and skid plate are angularly related so as to converge to close proximate relation thereby to define a narrow slit through which cardboard filler strips can pass but which precludes passage of the operator's hand.

DETAILED DESCRIPTION OF THE PREFERRED EMBODIMENT OF THE INVENTION

Figure 1:
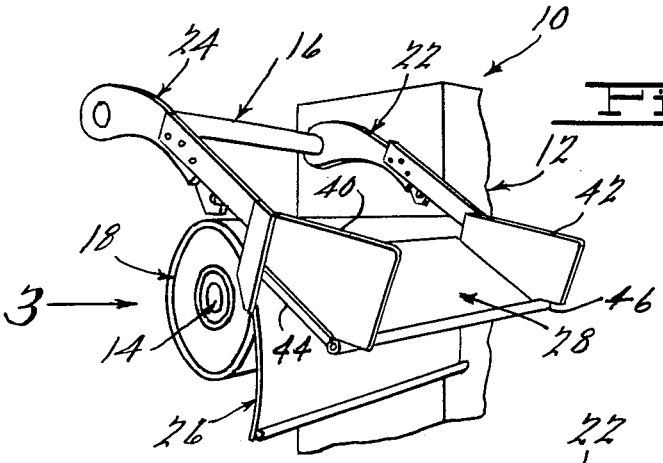
FIG. 1 is a perspective view of the recoiler guard of the present invention.
Figure 2:
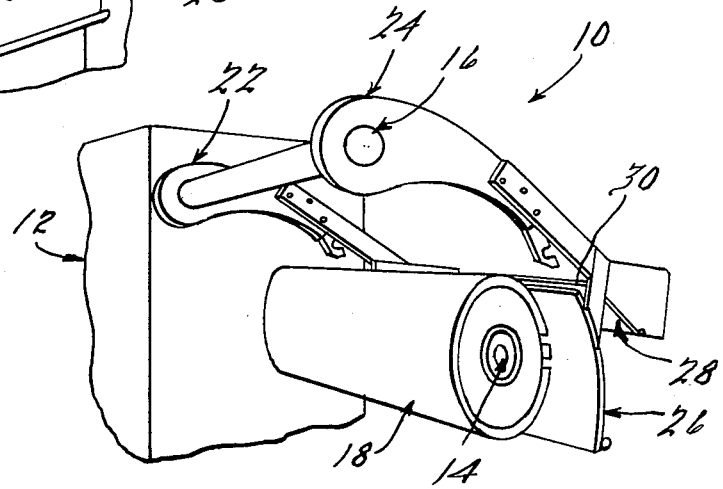
FIG. 2 is a view similar to FIG. 1 taken from a different angle.
Figure 3:
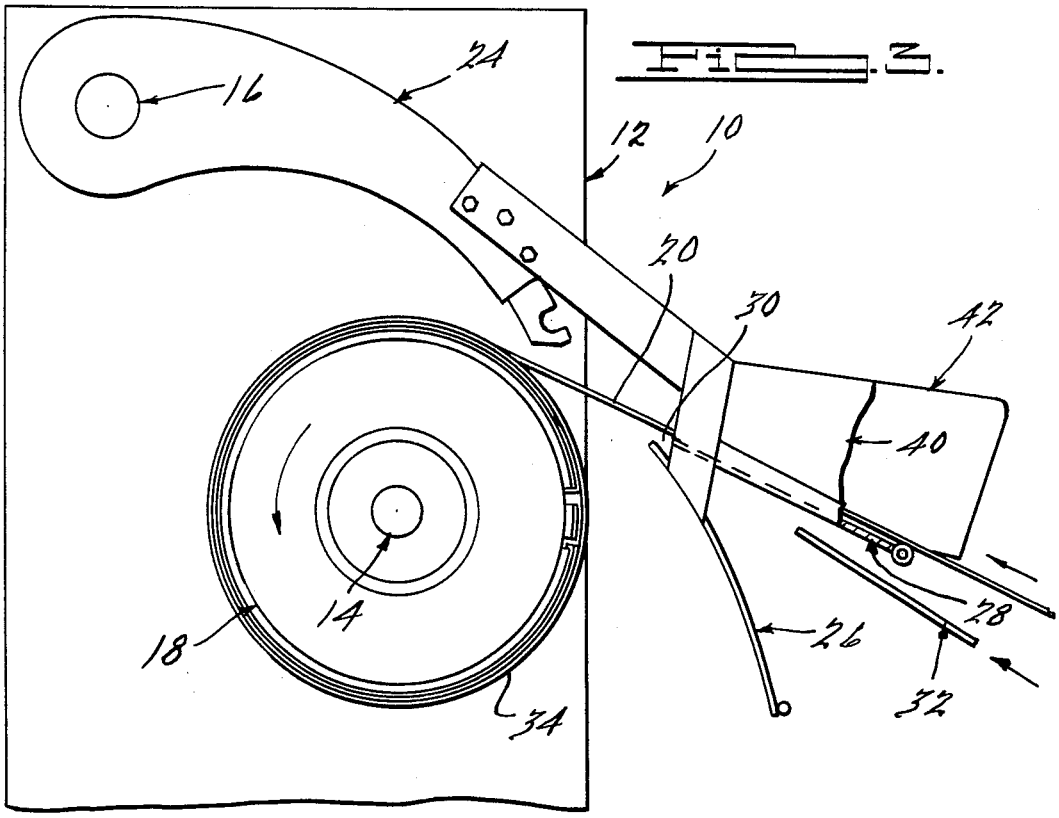
FIG. 3 is a view taken in the direction of the arrow 3 of FIG. 1.

A steel slitter recoiler guard 10 in accordance with the instant invention, comprises a mounting frame 12 for the support of a pair of parallel cantilevered shafts 14 and 16. The shaft 14 supports a takeup drum 18 which is driven by a motor (not shown) disposed internally of the frame 12. Rotation of the drum 18 in the counterclockwise direction, as seen in the drawings, results in windup of a strip of steel 20 thereon.

In accordance with the present invention, a pair of guard support arms 22 and 24 are journaled for rotation by the cantilevered shaft 16. The arms 22 and 24 are connected at their radially outer extremities by a drum shroud 26 of arcuate configuration and a skid plate 28 of generally plate-like configuration. The shroud 26 and the plate 28 converge towards one another in directions substantially tangentially related to the roll 18, respectively. The shroud 26 and plate 28 are spaced from one another at the apex of convergence so as to define a slit 30 extending parallel to the shaft 14 through which strips of cardboard 32 are admitted. The cardboard strips 32 are drawn between the outermost convolution 34 of the steel strip 20 and the portion of the steel strip 20 being admitted to the drum 18.

In accordance with another feature of the instant invention, a pair of upstanding shields 40 and 42 are secured to opposite ends 44 and 46, respectively, of the plate 28 so as to guide the steel strip 20 onto the drum 18 as well as to preclude access to the upper surface of the advancing steel strip 20.

From the foregoing description it should be apparent that the orientation of the shroud 26 and skid plate 28 in convergent relationship between the drum 18 and the advancing steel strip 20 defines a relatively narrow slit 30 which precludes contact between the hand of an operator and a "pinch point" between the outermost strip convolution 34 and the advancing strip 20. The slit 30 is wide enough to admit the cardboard 32 but sufficiently narrow to preclude even the fingers on the hand of an operator from protruding therethrough.

While the preferred embodiment of the invention has been disclosed, it should be appreciated that the invention is susceptible of modification without departing from the scope of the following claims.

I claim:

1. In a steel slitter recoiler comprising a rotatable takeup drum for the coiling of a strip of steel, an improved guard for protecting the hand of an operator feeding spacer material between convolutions of the steel on said drum comprising a drum shroud extending the full width of said drum and generally tangentially thereto and radially spaced therefrom, a skid plate extending the full width of said drum and generally tangentially thereto and radially spaced therefrom, both said shroud and said skid plate being disposed between an advancing portion of steel strip and convolutions of the steel strip on said drum, said shroud and skid plate being orientated at an acute angle relative to one another and spaced from one another adjacent the point of convergence therebetween so as to define a relatively narrow slit extending parallel to the axis of rotation of said drum, said slit extending the full width of said drum between said drum and the advancing strip of steel for the acceptance of spacer material between coils of steel.

2. A steel slitter recoiler guard in accordance with claim 1 including a pair of spaced support arms for the support of said drum shroud and skid plate, and means mounting said arms for rotation about an axis parallel to and radially spaced from the axis of rotation of said drum.

3. A steel slitter recoiler guard in accordance with claim 1 including a pair of upstanding shields at opposite ends of said skid plate.

* * * * *